United States Patent [19]

Claes et al.

[11] 4,149,877

[45] Apr. 17, 1979

[54] CONTROLLING PIG IRON REFINING

[75] Inventors: Jacques R. Claes, Liege; Pierre H. Dauby, Ougree, both of Belgium

[73] Assignee: Centre de Recherches Metallurgiques, Centrum voor Research in de Metallurgie, Brussels, Belgium

[21] Appl. No.: 764,644

[22] Filed: Feb. 1, 1977

Related U.S. Application Data

[63] Continuation of Ser. No. 589,669, Jun. 24, 1975, abandoned.

[30] Foreign Application Priority Data

Jun. 27, 1974 [BE] Belgium ..... 816992

[51] Int. Cl.[2] ..... C21C 5/30

[52] U.S. Cl. ..... 75/60

[58] Field of Search ..... 75/60

[56] References Cited

U.S. PATENT DOCUMENTS

| | | | |
|---|---|---|---|
| 2,529,387 | 11/1950 | Haglund | 75/60 |
| 3,533,778 | 10/1970 | Nilles et al. | 75/60 |
| 3,645,718 | 2/1972 | Murphy | 75/60 |
| 3,748,122 | 7/1973 | Ramachandran | 75/60 |

FOREIGN PATENT DOCUMENTS

| | | | |
|---|---|---|---|
| 819246 | 10/1949 | Fed. Rep. of Germany | 75/60 |
| 1422726 | 11/1965 | France | 75/60 |

*Primary Examiner*—P. D. Rosenberg
*Attorney, Agent, or Firm*—Holman & Stern

[57] ABSTRACT

Industrially pure oxygen is blown into molten pig iron surmounted by a layer of slag in a converter by means of at least one tuyere located below the upper surface of the molten metal. Input and output parameters are monitored and input parameters are controlled in order to obtain steel of a desired quality (e.g. composition and/or temperature). The intensity of sound emitted by the converter (e.g. in the range of from 20 to 50 Hz) is measured while the oxygen is blown in. The instant at which the intensity undergoes a sudden and considerable decrease is detected. From that instant, only that amount of oxygen is blown in which is necessary and sufficient to provide the steel with the desired quality at the end of the refining operation.

8 Claims, 5 Drawing Figures

CONTROLLING PIG IRON REFINING

This is a continuation of application Ser. No. 589,669, filed June 24, 1975, and now abandoned.

BACKGROUND OF THE INVENTION

The present invention relates to a pig iron refining process in which industrially pure oxygen is blown in by means of at least one tuyere located below the surface of the molten metal in a converter.

In known installations, the tuyere is generally in the bottom of the converter and comprises two co-axial ducts, the inner ducts being arranged to convey oxygen whereas the space between the inner duct and the outer duct is designed to convey a fluid, preferably an endothermic-decomposition fluid such as a hydrocarbon liquid or gas, to protect the tuyere and the refractory materials against the action of the pure oxygen.

Input and output parameters are monitored and input parameters are controlled in order to obtain steel of a desired quality. Fixed input parameters include the temperature and composition of the pig iron; variable input parameters include oxygen flow rate and the amount and timing of additions to the molten metal; output parameters include the temperature and composition of the waste gases. The desired quality may be, for example, the content of at least one component of the steel and/or the temperature of the steel. A number of methods of controlling the refining operation, when blowing oxygen through the bottom wall of the converter have already been suggested, for example methods based on material and heat balances and a mathematical model for calculating charges.

Theoretically, such methods permit the desired composition and temperature for the refined metal to be regularly obtained upon turn-down of the converter. However, a certain dispersion of the results thus obtained occurs in practice. The dispersion may be due to a lack of information on the charged materials, for example on the weight or the precise composition of the pig iron, the scrap, or the lime. To remedy such a situation, premature turn-down of the converter is generally provided, the iron content and the temperature of the slag are rapidly measured, and blowing is re-started with or without additions and is continued for the time necessary to obtain the desired composition and temperature of the steel.

The results thus obtained have been found to be satisfactory and dispersions, which generally occur when no premature tilting is practiced, are substantially reduced. However, certain difficulties still exist with regard to safety (preventing overflowing or slopping) and surely obtaining the desired temperature and composition of the steel at the end of the refining operation. Such difficulties may be due to the fact that the blowing conditions are not reproducible.

What is required is a procedure which allows these drawbacks to be eliminated with no need for the converter to be prematurely turned down.

It has unexpectedly been found that, by measuring the intensity of sound emitted by the converter it is possible in particular to detect the moment at which substantial dephosphorization of the molten metal is achieved. We have also been able to experimentally determine the existence of a relationship between the quantity of oxygen blown in from the moment at which dephosphorization is achieved and the iron content in the slag.

It is known that the precise moment of the end of the refining operation corresponds to a definite critical iron content of the slag. In the case of phosphoric pig iron, the iron content of the slag is strictly related to the phosphorus content of the molten metal.

Accordingly, measurement of the intensity of sound from the converter can be used to determine the precise moment when the refining operation is terminated.

SUMMARY OF THE INVENTION

In view of the above, the method according to the present invention substantially comprises measuring the intensity of sound from the converter, at least at the end of the oxygen blowing-in period, detecting the instant at which the sound intensity undergoes a sudden and substantial decrease, and, from that instant onwards, blowing into the converter an amount of oxygen necessary to attain the precise moment of the end of refining corresponding to the desired quality of steel.

In the case where phosphoric pig iron is refined, the instant at which the intensity of the sound undergoes a sudden decrease corresponds to that at which substantial dephosphorization of the molten metal is obtained. The required amount of oxygen is determined from the relationship (previously determined for the installation employed) between the iron content of the slag and the amount of oxygen blown in after dephosphorization.

As mentioned above, there is a definite critical iron content of the slag corresponding to the end of the refining operation. This critical iron content is previously determined through various methods either experimentally by taking advantage of other, similar refining processes, or mathematically by using mathematical models of calculation of charges (static model).

The desired quality of the steel may be defined by its chemical composition (e.g. the content of one or more of its components) and/or by its temperature.

It was also found that the intensity of the sound picked up within the frequency range of from 20 to 50 Hz is particularly significant for monitoring the refining operation.

BRIEF DESCRIPTION OF THE DRAWINGS

The invention will be described further, by way of example only, with reference to the accompanying drawings, in which.

DETAILED DESCRIPTION OF THE PREFERRED EMBODIMENT

Figure 1:
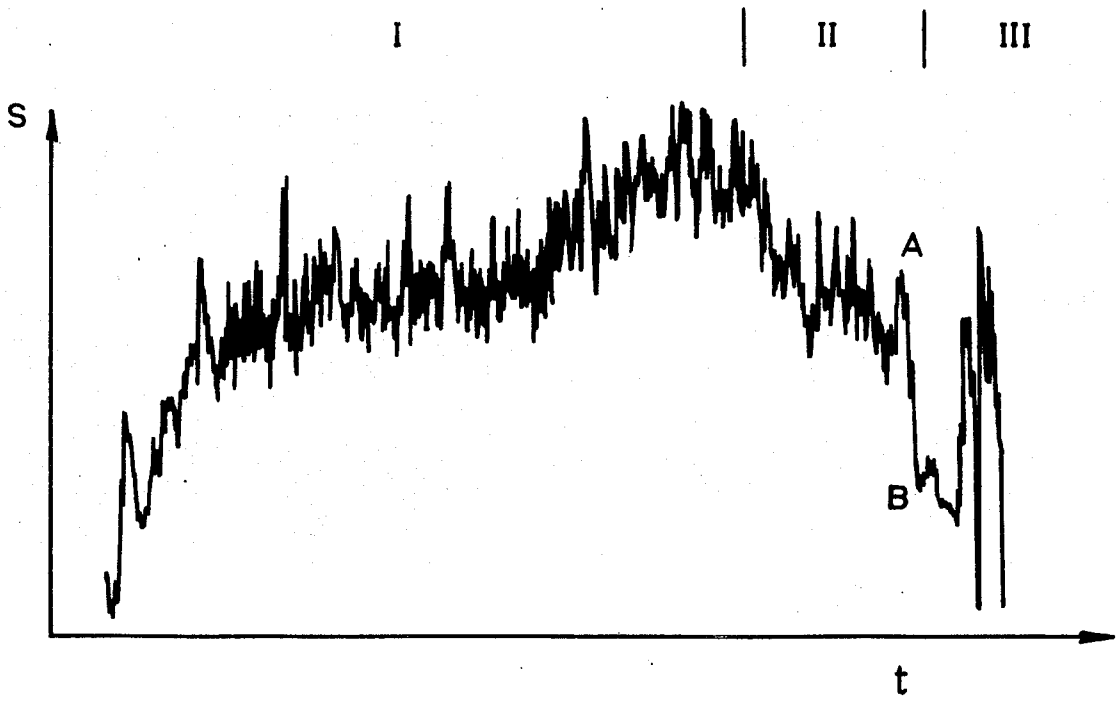
FIG. 1 is a graph of the intensity (s) of sound emitted by a converter, against time (t)

With reference to FIG. 1, the course of the sound intensity graph can be decomposed into three periods closely related to the metallurgical phases of the conversion process:

Phase I: decarburization taking place during about three quarters of the total refining time;

Phase II: dephoshorization, extending up to about 95% of the total refining time; the duration of this phase depends on the type of pig iron (phosphoric pig iron or hematite pig iron);

Phase III: oxidation of iron, which determines the phosphorus content remaining in the steel and terminates the refining operation.

The end of phase II. i.e. the end of the period of substantial dephosphorization, is characterized by a sudden and considerable drop (A,B) in the intensity (S) of the sound from the converter (FIG. 1). This abrupt drop can be noted easily by an operator observing a recorder recording the graph of the sound intensity; thus the detection of the abrupt decrease in sound intensity does not necessarily require the use of an electronic component if this is not a part of an automatic control equipment. It will be noted that it is not necessary to monitor the sound intensity during phase I.

Figure 2:
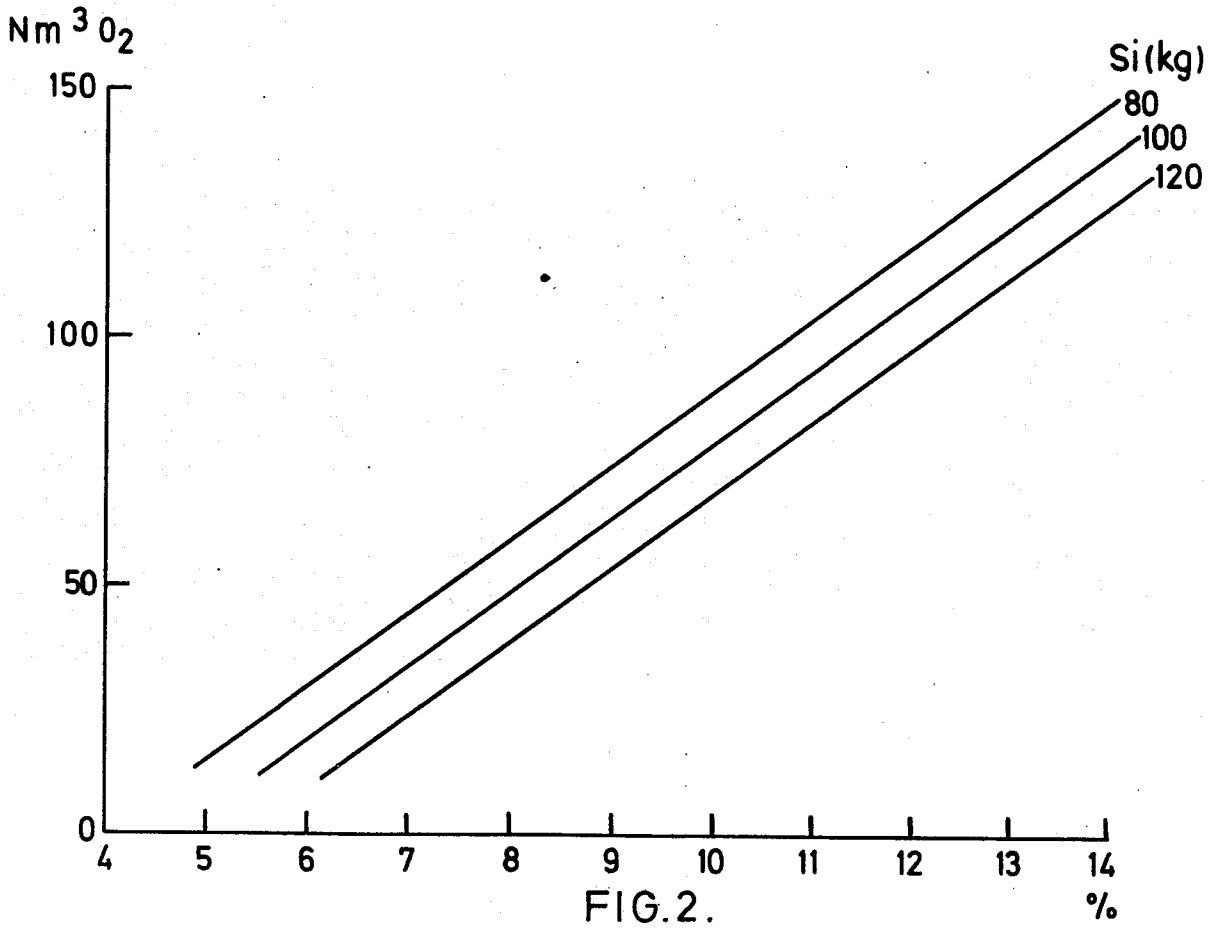
FIG. 2 is a graph of the amount of oxygen blown in (in $Nm^3$) after substantial dephosphorization, against the iron content (%) of the slag, for various initial amounts of silicon in the molten pig iron.

The volume of oxygen blown in during phase III permits the iron content of the slag upon turn-down of the converter to be forseen with good accuracy. The relationship is shown in FIG. 2; checking on withdrawn samples has confirmed that this relation corresponds well to a series of reproducible states of the molten metal. The choice of the weight of the charged silicon as a parameter allows dispersion of the results to be reduced, dispersion being due not only to inaccuracy in measurements but also to the dispersion of the charges.

The relationship shown in FIG. 2 is particularly interesting for determining the termination of the refining of phosphoric pig iron.

The intensity of the recorded noise abruptly decreases near the end of the refining operation. This decrease has been found to be in direct relationship not only with the phosphorus content of the metal (as mentioned above) but also with the iron content of the slag. From this instant, it is then possible, independently of the charging conditions, to determine the amount of oxygen still to be blown in to obtain the iron content desired in the slag (in the case of hematite cast iron), in accordance with the unequivocal and reproducible relations established between these quantities.

Taking into account these observations, at the end of the sudden and considerable drop of the intensity of the sound from the converter, the amount of oxygen necessary to attain the precise moment of the end of the refining corresponding to the final iron content desired in the slag is blown in.

On the other hand, as far as the reactions proper taking place during the refining operation are concerned, there are a number of difficulties due to the amount of projections emitted by the molten material and the consequent formation of a crust in the converter mouth. These phenomena are, of course, detrimental to the productivity of the steel plant. To obviate these inconveniences and to take advantage of knowledge of the quality of the charged materials and the accuracy of the measuring detectors, based on considerations referred to below, the refining period preceding the instant at which a sudden drop in the sound intensity from the converter is detected is controlled in the manner explained below.

During research, the thickening of crust in the converter mouth was measured and it was found that this characteristic is strictly related to the amount of projections emitted during blowing and that the amount of projections directly depends on the value of the decarburization rate, provided that during the first part of the refining operation a constant oxygen supply rate is maintained.

Accordingly, it is convenient to carry out the refining operation in two stages:

(a) first stage: blowing in oxygen at a constant rate; and (b) second stage: blowing in oxygen at the maximum rate technologically possible.

The parameters which have an effect on the value of the oxygen supply rate during the first stage are, for example: the age of the converter lining, the initial silicon content of the pig iron, the charge of the converter, and the weight of ore fed in. A diagram obtained by grouping these influences practically permits a uniform oxygen supply rate to be fixed for use during the first refining stage.

On the other hand, a transition between the two refining stages can be easily determined by means of an analyzer which detects the carbon oxide content of the gas leaving the converter. The transition in fact coincides with the occurrence of a sudden and considerable drop in the decarburization rate and in the carbon oxide content of the gas from the converter.

On the basis of these considerations, the preferred procedure comprises the following stages, which precede the instant at which the abrupt drop in the intensity of the sound from the converter is detected:

(a) carrying out the first refining stage by blowing oxygen at a constant rate, the value of the rate being determined by means of a diagram which groups the influence on this magnitude of parameters such as the age of the converter lining, the silicon content of the pig iron, the charge of the converter, and the weight of ore fed in;

(b) measuring the carbon oxide content of the gas from the converter, detecting the moment at which this content undergoes a sudden and considerable decrease, and thereupon terminating the first refining period by increasing the oxygen supply rate to substantially the maximum technologically possible value; and (c) carrying out the second refining stage by maintaining the oxygen supply rate at substantially the maximum technologically possible value.

Advantageously, the value of the oxygen supply rate to be maintained during the first stage of refining is determined by making use of an abacus or table taking into account the influence of the age of the converter lining and the influence of the silicon content of the pig iron.

Figure 3:
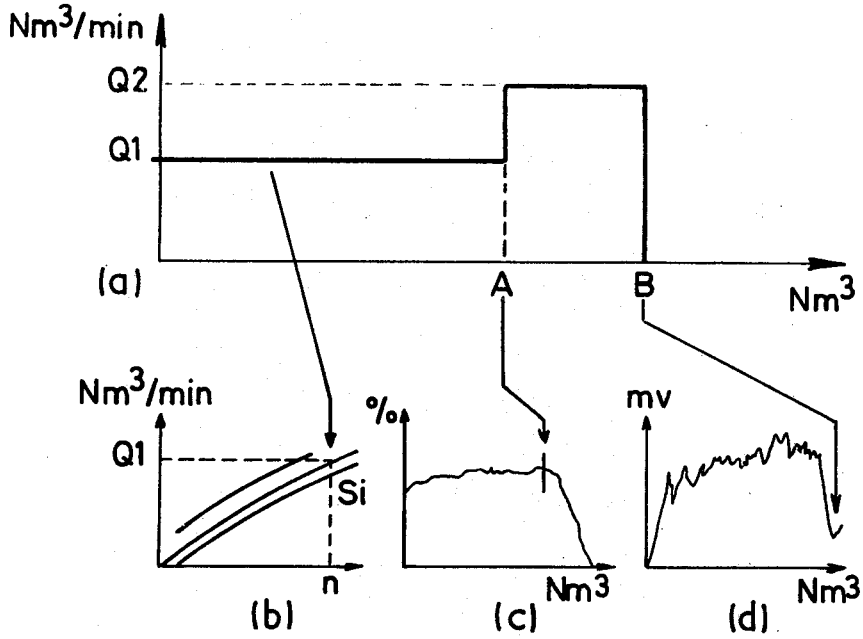
FIG. 3 shows graphs of various parameters of the refining process.

FIG. 3 illustrates four graphs a, b, c, and d. Graph a shows the variation of the oxygen blowing rate during the two stages of the refining operation. Graph b indicates how the oxygen blowing rate ($Q_1$) during the first stage of refining is determined as a function of the two following parameters: the age of the converter lining and the silicon content of the charged pig iron. Graph c shows detection of the moment at which the first refining stage has to be terminated. Graph d relates to detection of the instant from which the count down for the oxygen has to be started to end the refining operation.

Figure 4:
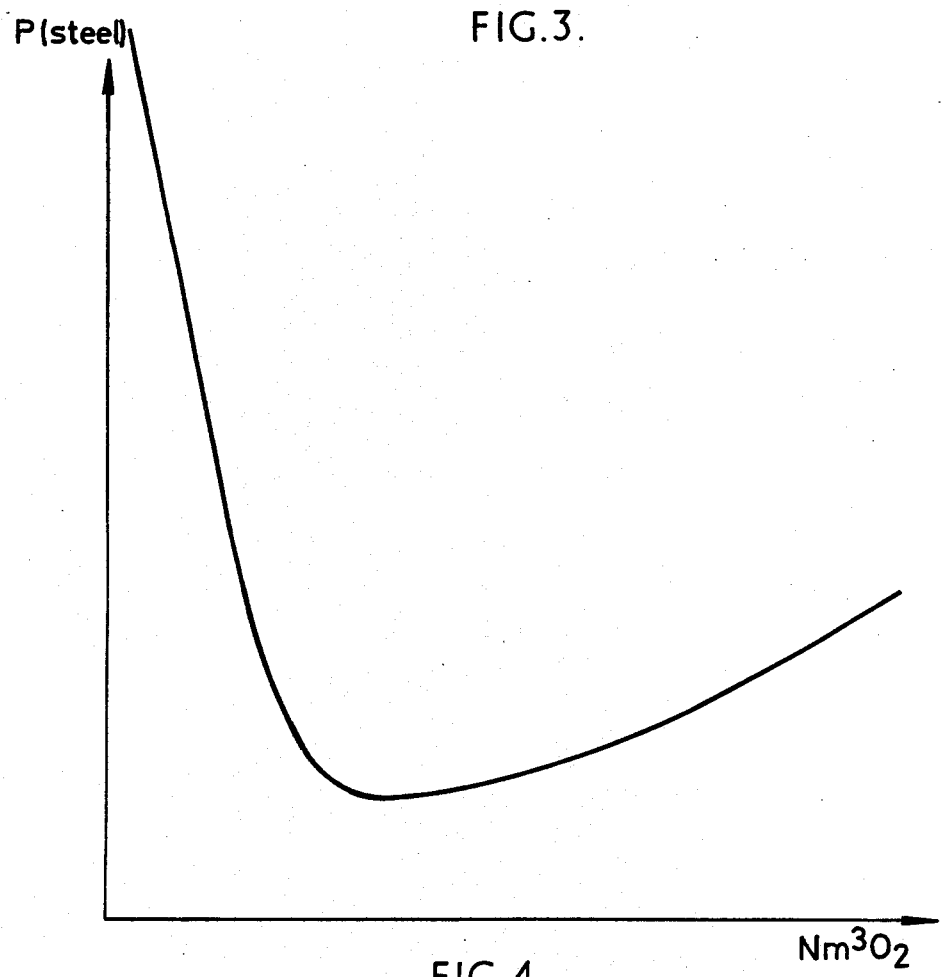
FIG. 4 is a graph of the phosphorus content of the molten metal, against the amount of oxygen blown in after an abrupt drop in the sound intensity from the converter.

FIG. 4 shows the relation existing for a given installation between the phosphorus content of the steel and the amount of oxygen blown in after the abrupt drop in the measurement signal indicating the intensity of sound.

Figure 5:
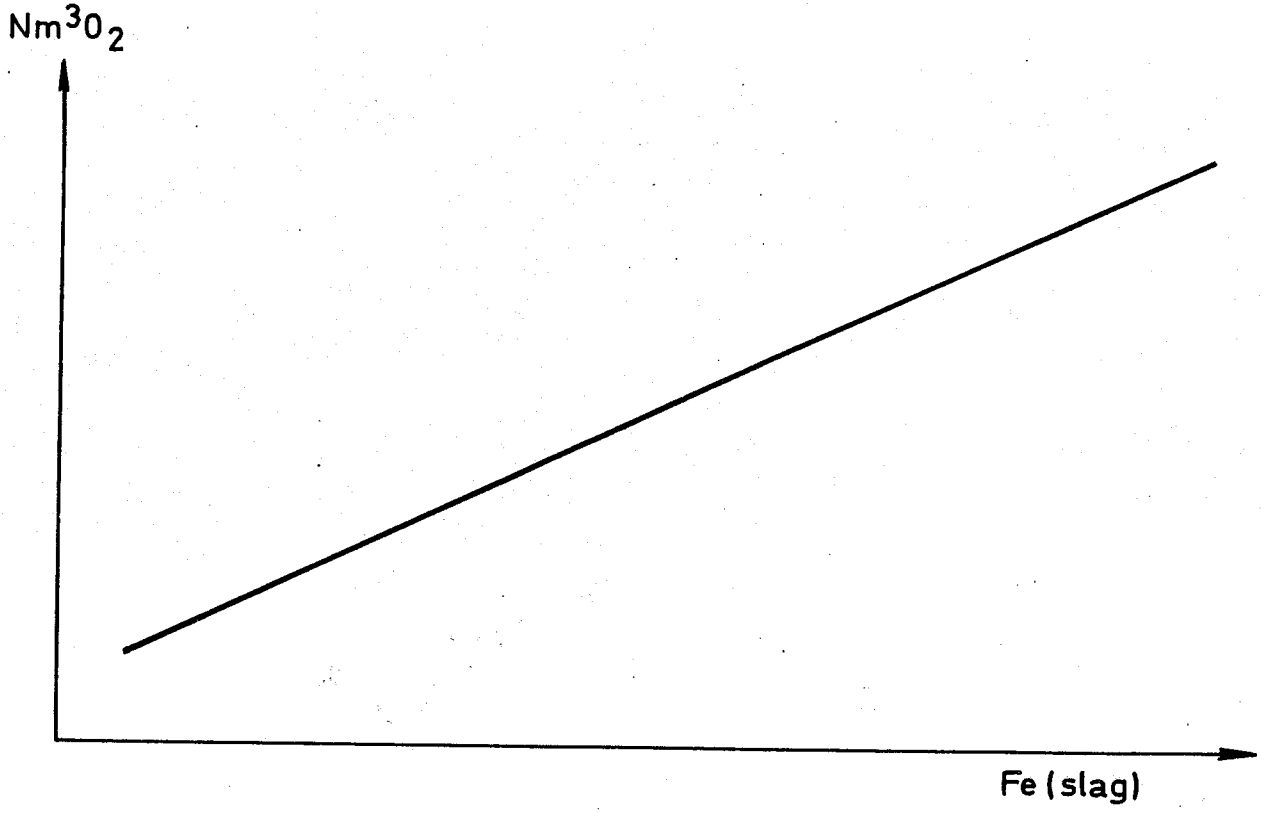
FIG. 5 is a graph of the amount of oxygen blown in after an abrupt drop in the sound intensity from the converter against the iron content of the slag.

FIG. 5 illustrates the relation existing (for a given installation) between the iron content of the slag and the amount of oxygen blown in after the abrupt drop in the measurement signal indicating the intensity of the sound.

According to FIG. 3*a* where rates ($Nm^3$/min) are indicated as the ordinates and the volume of oxygen blown in ($Nm^3$) is indicated as the abscissa, the first stage of refining is carried out by blowing at a constant rate $Q_1$. At the end of this first stage of blowing, the oxygen rate is modified from the value $Q_1$ to a value $Q_2$ which is substantially the maximum technologically possible rate. The rate $Q_2$ is kept constant during the second refining stage.

FIG. 3*b* is a graph in which the oxygen supply rates (in $Nm^3$/min) are indicated as the ordinates and the age of the converter lining (in number of castings made) is indicated as the abscissa, curves being given as a function of the silicon content of the pig iron. Knowing the age of the converter lining and the silicon content of the charged pig iron, the rate $Q_1$ for the first refining stage can be determined.

In FIG. 3*c* the carbon oxide contents (in %) in the gas from the converter are indicated as the ordinates and the volume (in $Nm^3$) of oxygen blown in is indicated as the abscissa. The end of the first stage of refining corresponds to the moment at which the carbon oxide content begins to rapidly decrease.

In FIG. 3*d* the intensity of the sound from the converter (expressed in millivolts, for example) is indicated as the ordinates and the volume (in $Nm^3$) of oxygen blown in is indicated as the abscissa. The beginning of the final phase of the refining operation corresponds to the instant at which a rapid and considerable decrease in the sound intensity occurs.

In FIG. 4 the phosphorus content (in %) of the steel is indicated as the ordinate and the volume (in $Nm^3$) of oxygen blown in is indicated as the abscissa. It should be noted that the phosphorus content of the steel as a function of the volume of oxygen blown in after the abrupt sound drop goes through a minimum. This relation permits the volume of oxygen which has still to be blown in after the abrupt drop in the measurement signal to be easily determined in order to obtain a predetermined content of phosphorus. Frequently, the final content of phosphorus sought is the minimum.

In FIG. 5 the iron content (in %) of the slag is indicated as the abscissa and the volume (in $Nm^3$) of oxygen blown in is indicated as the ordinate. It should be noted that the iron content of the slag increases as a function of the volume of oxygen blown in after the abrupt decrease of the signal representing the sound intensity. This relation permits the volume of oxygen which has still to be blown in after the abrupt decrease in the measuring signal to be easily determined to obtained a pre-determined iron content of the slag.

We claim:

1. In a pig iron refining process in which industrially pure oxygen is blown into molten pig iron surmounted by a layer of slag in a converter by means of at least one tuyere located below the upper surface of the molten metal, input and output parameters being monitored and input parameters being controlled in order to obtain steel of a desired condition to which corresponds a given iron content of the slag, the improvement comprising the steps of measuring the intensity of sound emitted by the converter while the oxygen is blown in, the sound being within the frequency range of from 20 to 50 Hz, detecting the instant at which the intensity of the sound undergoes a sudden and considerable decrease, and, from that instant, blowing in only that amount of oxygen which is necessary and sufficient to provide the slag with the given iron content at the end of the refining operation, the amount of oxygen being determined from an empirically pre-determined relationship between the iron content of the slag and the amount of oxygen blown in after the instant.

2. The process as claimed in claim 1, further comprising the following steps, preceding the instant; blowing in oxygen at a constant rate, measuring the carbon oxide content of the gas emerging from the converter, and, after the carbon oxide content undergoes a sudden and considerable decrease, raising the oxygen blowing rate to substantially the maximum practicable rate.

3. The process as claimed in claim 2, in which the constant rate is a function of the age of the converter lining and the initial silicon content of the pig iron.

4. The process as claimed in claim 1, in which the desired condition of the steel comprises its temperature.

5. The process as claimed in claim 1, in which the desired condition of the steel comprises its composition.

6. The process as claimed in claim 1, in which the pig iron is phosphoric pig iron.

7. The process as claimed in claim 1, in which the pig iron is hematite pig iron.

8. In a pig iron refining process in which industrially pure oxygen is blown into molten pig iron surmounted by a layer of slag in a converter by means of at least one tuyere located below the upper surface of the molten metal, input and output parameters being monitored and input parameters being controlled in order to obtain steel of a desired condition to which corresponds a given phosphorus content of the molten metal, the improvement comprising the steps of measuring the intensity of sound emitted by the converter while the oxygen is blown in, the sound being within the frequency range of from 20 to 50 Hz, detecting the instant at which the intensity of the sound undergoes a sudden and considerable decrease, and, from that instant, blowing in only that amount of oxygen which is necessary and sufficient to provide the molten metal with the given phosphorus content at the end of the refining operation, the amount of oxygen being determined from an empirically predetermined relationship between the phosphorus content of the molten metal and the amount of oxygen blown in after the instant.

* * * * *